US006890615B2

(12) United States Patent
Horwich et al.

(10) Patent No.: US 6,890,615 B2
(45) Date of Patent: May 10, 2005

(54) STRAIGHT STITCH CARPETS WITH ONE OR MORE PRE-DEFINED TRIM LINES AND METHODS OF THEIR MANUFACTURE USING TUFTING EQUIPMENT

(75) Inventors: James Horwich, Beverly Hills, CA (US); Kenneth W. Bitting, Huntington Beach, CA (US); Stanley E. Dunford, Irvine, CA (US)

(73) Assignee: Atlas Carpet Mills, Inc., Los Angeles, CA (US)

( * ) Notice: Subject to any disclaimer, the term of this patent is extended or adjusted under 35 U.S.C. 154(b) by 141 days.

(21) Appl. No.: 10/412,381

(22) Filed: Apr. 11, 2003

(65) Prior Publication Data

US 2004/0202815 A1 Oct. 14, 2004

(51) Int. Cl.[7] ..... B32B 3/02; B32B 33/00; B32B 31/18; E04F 15/00

(52) U.S. Cl. ..... 428/89; 428/88; 428/62; 156/304.1; 156/304.5; 156/304.7; 52/746.1

(58) Field of Search ..... 428/88, 89, 57, 428/58, 61, 62, 81, 82; 156/304.1, 304.3, 304.4, 304.5, 304.6, 304.7; 83/13; 52/746.1; 7/103; 16/4–17

(56) References Cited

U.S. PATENT DOCUMENTS

| | | | | |
|---|---|---|---|---|
| 3,688,804 A | * | 9/1972 | Brown et al. | 139/1 R |
| 3,772,785 A | * | 11/1973 | Fischer | 30/293 |
| 4,536,244 A | | 8/1985 | Greci et al. | |
| 4,613,396 A | | 9/1986 | Scarborough | |
| 4,656,901 A | | 4/1987 | Axford et al. | |
| 4,671,977 A | | 6/1987 | Berry | |
| 5,159,758 A | * | 11/1992 | MacDonald | 30/294 |
| 5,484,639 A | | 1/1996 | Woodall et al. | |
| 5,485,676 A | | 1/1996 | Terhorst | |
| 5,925,434 A | | 7/1999 | Phillips et al. | |
| 6,012,261 A | | 1/2000 | McDonald | |
| 6,344,254 B1 | | 2/2002 | Smith et al. | |
| 6,421,923 B1 | * | 7/2002 | Nguyen | 30/287 |

FOREIGN PATENT DOCUMENTS

| | | | | |
|---|---|---|---|---|
| GB | 2225270 A | * | 5/1990 | B26D/7/01 |

* cited by examiner

*Primary Examiner*—Cheryl A. Juska
(74) *Attorney, Agent, or Firm*—Blakely Sokoloff Taylor & Zafman

(57) ABSTRACT

A pre-defined trim line within a carpet between a usable portion of carpet and a trim edge. The trim line may be formed by avoiding the tufting of yarn or by the removal of a tufting of yarn along a row. In one aspect of an embodiment of the invention, the pre-defined trim line provides an identifier of where to cut a patterned carpet to provide a high quality seam. Another aspect of an embodiment of the invention provides a gap for installers to easily cut between rows of yarn without unintended cross-cuts and also speeds the installation.

39 Claims, 7 Drawing Sheets

FIG. 5
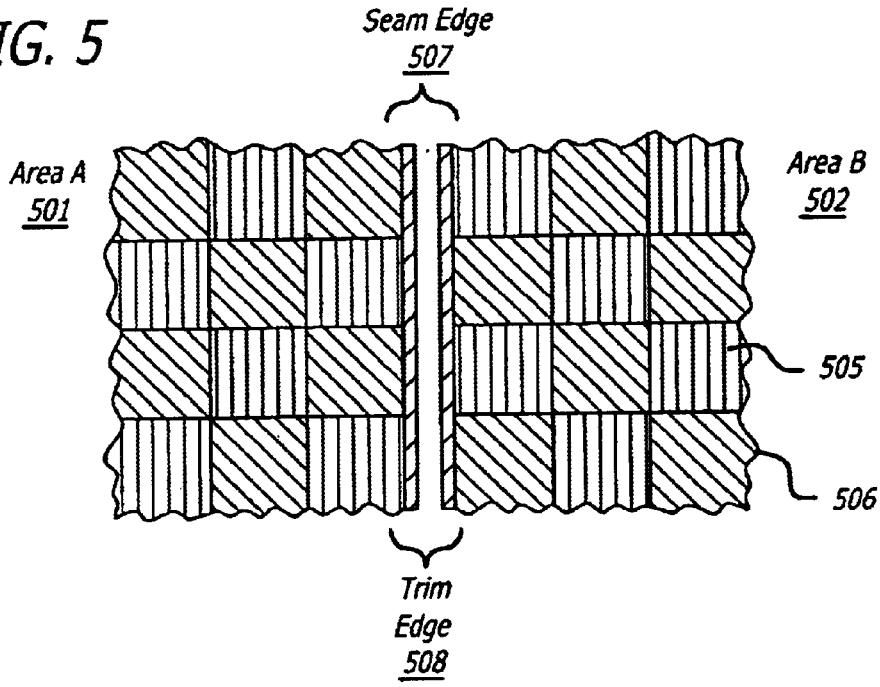
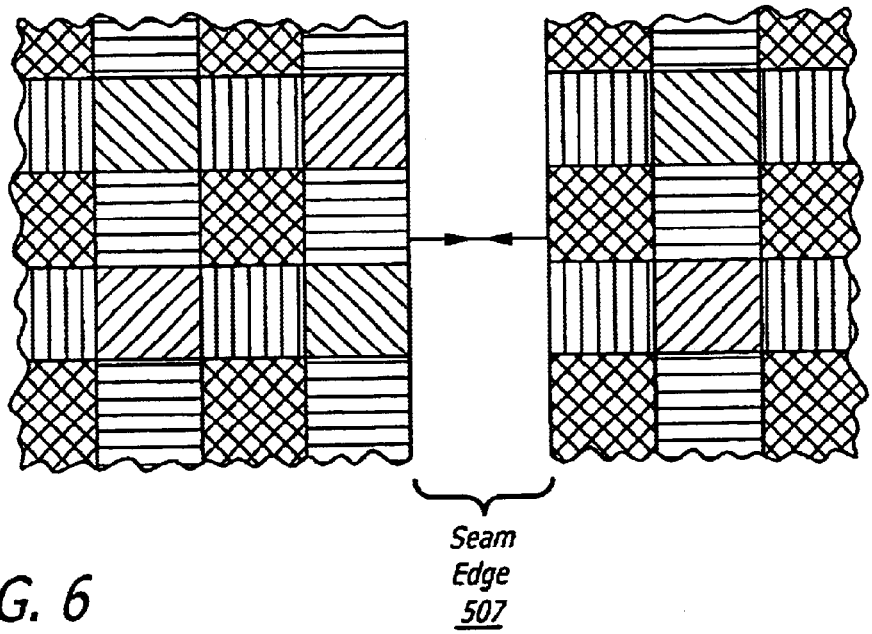
FIG. 6

FIG. 9
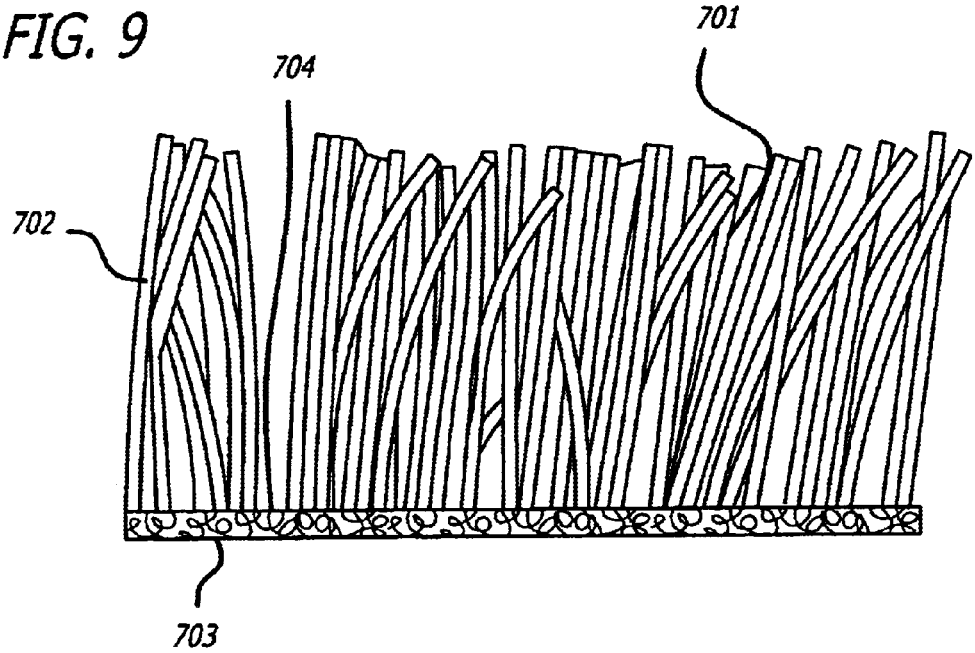
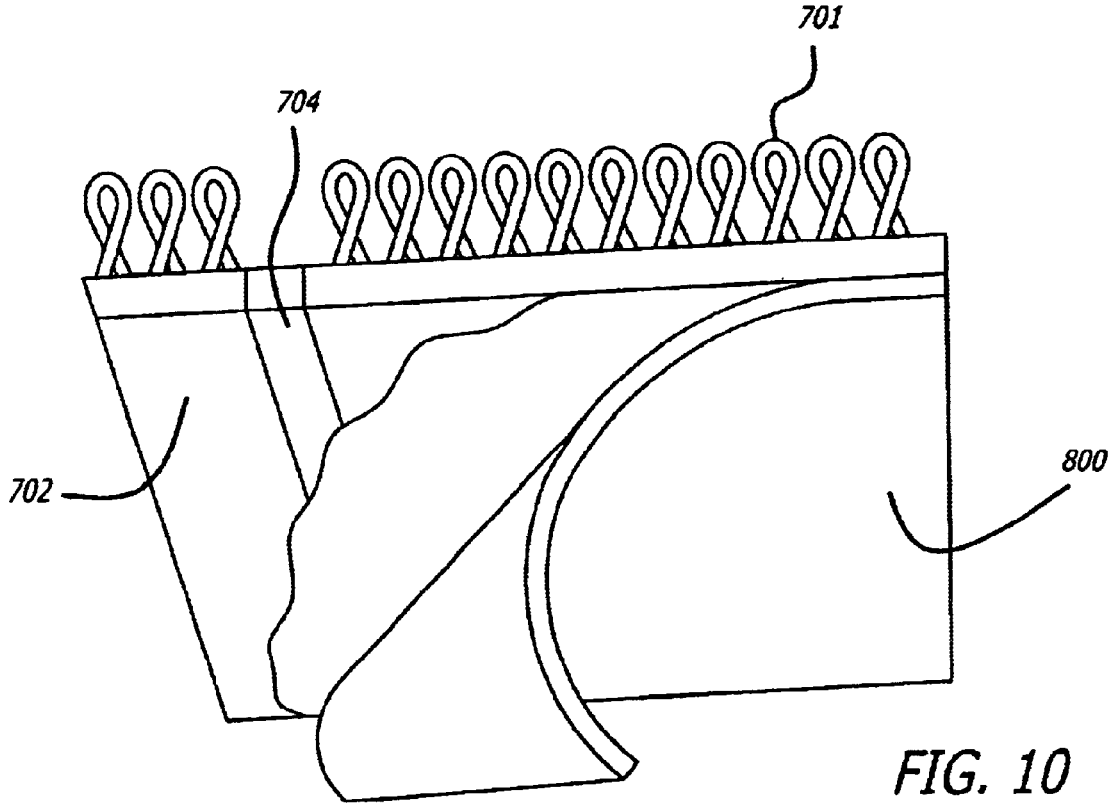
FIG. 10

FIG. 11
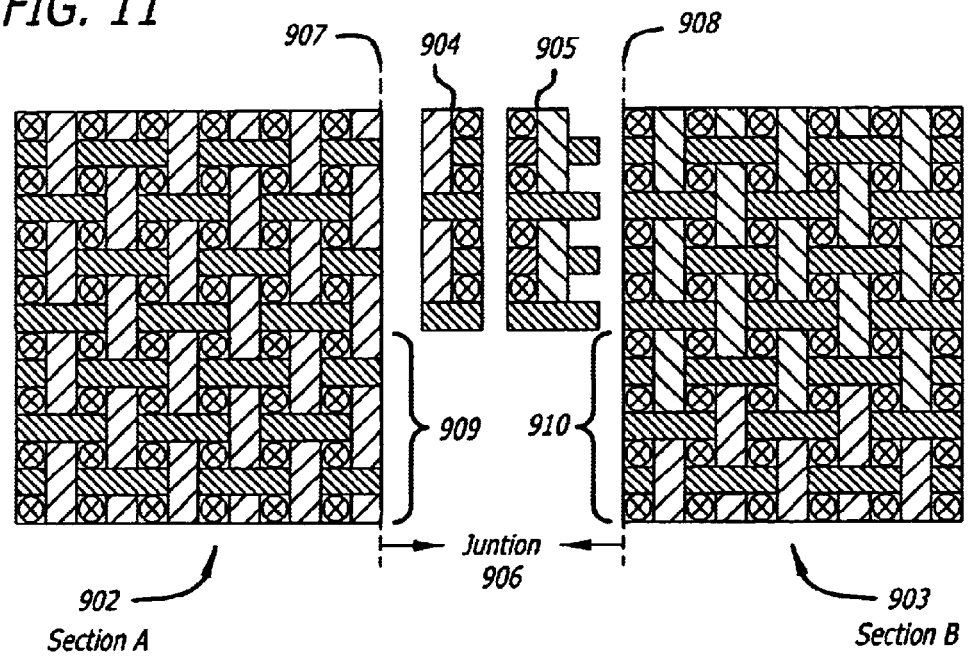
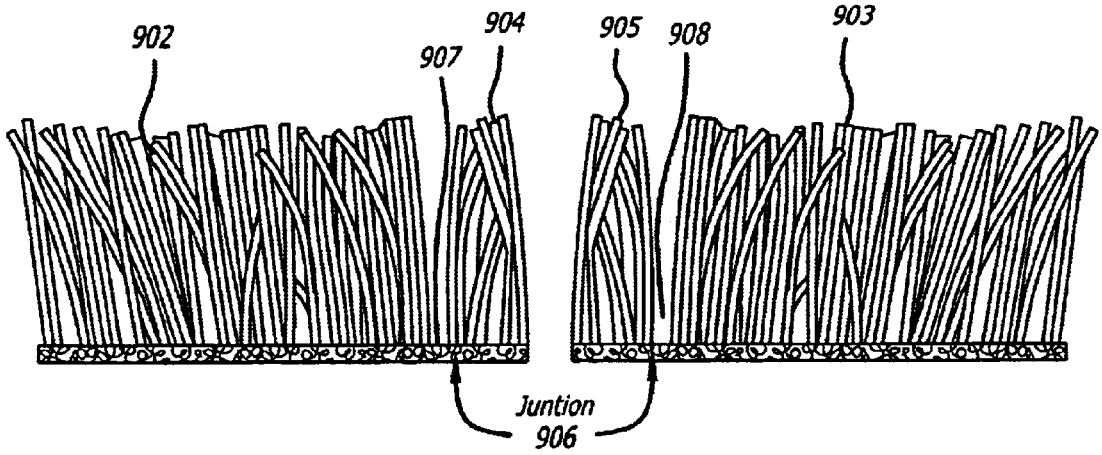
FIG. 12

FIG. 13
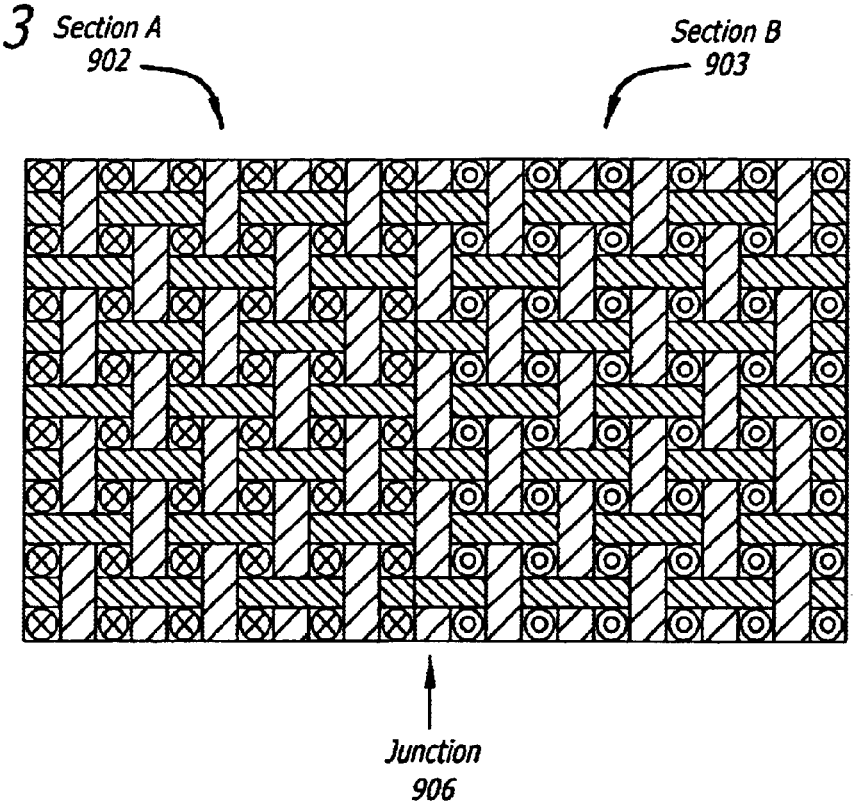
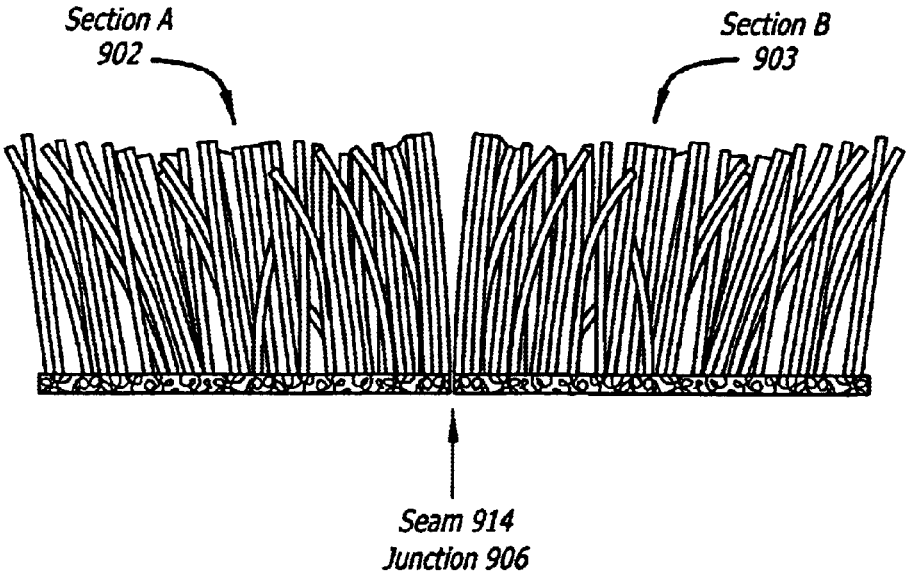
FIG. 14

STRAIGHT STITCH CARPETS WITH ONE OR MORE PRE-DEFINED TRIM LINES AND METHODS OF THEIR MANUFACTURE USING TUFTING EQUIPMENT

FIELD

The embodiments of the invention are generally related to carpets and their manufacture. More particularly, the embodiments of the invention relate to carpet production techniques forming pre-defined trim lines and carpets with pre-defined trim lines for ease of trimming and for joining carpets together and forming a seam there between.

BACKGROUND

Carpets are typically formed by tufting yarn into a backing and then applying a polymeric coating on the back side of the backing to lock the tufts of yarn and the backing together. The terms "tuft", "tufting", "tufted", and "tufted-in" refer to the process of yarn being inserted into the backing. The backing may be referred to as a carpet backing. The majority of broadloom carpet, including patterned carpet, is manufactured on tufting equipment.

The process of tufting carpet generally consists of feeding the carpet backing through tufting equipment where yarn is then tufted into the carpet backing by one or two rows of needles. Tufting equipment typically contains five hundred (500) to twenty-five hundred (2500) needles across the width of the machine, depending on width of the carpet and gauge of the machine. Gauge refers to the spacing between the needles. For example, one-twelfth (1/12) gauge means there are twelve (12) needles per inch across the width. If a carpet is tufted twelve (12) feet wide on a one-twelfth (1/12) gauge machine, there are one thousand seven hundred twenty-eight (1728) needles across the width of the carpet.

Patterns may be formed in carpets in various ways such as by using yarn textures (e.g., loop, sheared loop, cut), yarn color, and more recently, pile height. Historically, patterns on carpets were manufactured by using different color yarns and shifting the needle bars in tufting machines. Depending on color placement of the yarn and shift sequence of the needle bars, manufacturers could create patterns or overall textures.

With the use of servo-motors and/or pneumatic valves in the yarn feed systems of tufting machines, manufacturers are able to create patterns with pile height variation. Using pile height variation, patterns may be created without shifting the needle bars, and the yarn may be tufted into the backing in straight lines or rows.

Carpets are often designed with a repeating design or pattern. For example, across the width of a patterned carpet, a pattern may repeat one or more times.

It is often desirable to join two or more sheets of carpet along a seam in order to cover a desired area. Along each edge of the patterned carpet, manufacturers usually "tuft-in" extra ends (i.e., rows) of yarn, to permit installers to trim back the edges to form a good quality seam between the sheets of carpet. Installers must carefully identify where the last pattern repeat falls near the trim edge of the carpet, and then cut the carpet between ends of yarn to get the pattern to match at seams on the face of the carpet. Installers cut from the top side of the carpet since the patterns are not visible from the back side of the carpet. Trimming the carpet can be difficult and time-consuming, since it is often difficult to identify exactly where a pattern repeats. Moreover, the thickness of the carpet and backing, the gauge of the machine, the type of yarn, and the size of the yarn often causes unintended cross cuts between rows of carpet yarn, which may create an unacceptable pattern match.

The extra ends of yarn tufted into the backing (often referred to as the trim edge) permit installers to cut back the edges of the carpet that may have been damaged during transit to the job site, or to eliminate any manufacturing inconsistencies that may occur at the edges of the carpet. On patterned carpet, the extra ends of yarn are trimmed off between specific rows of yarn near the edge of each sheet of carpet being joined together so that the patterns match when the two sheets of carpet are installed on a floor side by side. This is often referred to as sidematching. If the trimming is performed between the wrong rows, there will be a mismatch in the pattern when the two sheets of carpet are joined together.

On patterned carpet, if a carpet manufacturer does not tuft the extra ends into a carpet for cutting back, the installer would most all of the time be required to trim a full pattern repeat (e.g., six inches, one foot or more depending on the pattern size) in order to get the patterns to match up on the face of the carpet at the seam. Trimming back more than an inch or so on each edge is wasteful, expensive and considered unacceptable by the trade. Therefore, additional tuft rows are usually included on both edges of patterned carpets. Furthermore, with patterned carpet there is an additional requirement that the carpet edge be trimmed back to achieve a pattern match when the carpet is seamed. On some carpets, it is difficult to identify exactly where a pattern repeats due to the subtlety of patterns. Furthermore, once an installer locates the rows of yarn to cut between, it can be difficult to cut between the rows of yarn because the rows are close together. This is especially true on tufting, equipment with gauges ranging from 1/10 to 1/20 of an inch, which is typical of new patterned tufting equipment.

BRIEF DESCRIPTION OF THE DRAWINGS

FIG. 5 illustrates where two sections of carpet are to be joined along a seam according to one embodiment of the invention.

FIG. 6 illustrates an example of another patterned carpet that may be employed according to one embodiment of the invention.

FIG. 9 illustrates the view from the edge of the finished carpet that identifies the precise yarn rows of trimming the pattern match point.

FIG. 10 illustrates the exposed bottom view of the finished carpet match point with a secondary backing or cover pulled away.

FIG. 11 illustrates how two sections of patterned carpet may be joined along a pre-defined trim line according to one embodiment of the invention.

FIG. 12 illustrates the view from the edge of the finished carpet how the two sections of patterned carpet illustrated in FIG. 11 may be joined along a pre-defined trim line according to one embodiment of the invention.

FIG. 13 illustrates the view from the top surface of the carpet how the two sections of patterned carpet illustrated in FIG. 11 have been joined along the seam line according to one embodiment of the invention.

FIG. 14 illustrates the view from the edge of the finished carpet that shows how the two sections of patterned carpet illustrated in FIG. 11 have been joined along the seam line according to one embodiment of the invention.

DETAILED DESCRIPTION

In the following detailed description of various embodiments of the invention, numerous specific details are set forth in order to provide a thorough understanding of various aspects of one or more embodiments of the invention. However, one or more embodiments of the invention may be practiced without these specific details. In other instances, well known methods, procedures, and/or materials have not been described in detail so as not to unnecessarily obscure aspects of embodiments of the invention.

In the following description, certain terminology is used to describe certain features of one or more embodiments of the invention. For instance a "carpet backing may be selected from a variety of materials including a woven fabric, mesh, polypropylene fabric, fiberglass, polyester, jute, etc. and/or any combination thereof. The terms "tuft", "tufting", "tufted", "tufted-in", and other verb tenses thereof refer to inserting, pressing, passing, and/or any other process by which yarn is attached to the carpet backing. The term "carpet yarn" refers to yarn tufted into the usable portion of a carpet. The "usable portion" of a carpet refers to that portion which is intended to be installed (e.g., excluding trimming edge portions). The term "trim yarn" refers to yarn tufted into the trimming edges, which are typically cut off before final installation of a carpet.

One aspect of the invention provides a novel technique for readily identifying where to cut a carpet and also provides a gap for the installers to easily cut between ends of yarn. The invention can identify where the edge of the carpet should be trimmed in order to obtain a high quality side match when two sheets are installed side by side. This aspect of the invention permits identifying pattern repeats at the edge of a carpet to ease and speed installation of the carpet.

According to one embodiment of the invention, a pre-defined trim line is included in the carpet between the usable portion of a carpet and the trim edge. The invention forms a gap to identify where near an edge the carpet can be easily trimmed, as opposed to cutting between two rows of yarn that are spaced very close together. Hereinafter, in one embodiment, a "row" is considered a selected path formed by yarn or a lack of yarn.

This aspect of the invention may be implemented near the edge of any type of carpet, in particular a straight stitch broadloom carpet. This is done by removing one end of yarn from the tufted "greige" just outside the usable portion of a patterned carpet along each edge of the carpet. In another embodiment, the tufting machine is set-up to skip a row where yarn would otherwise be tufted into the backing. The invention may be employed with any type of pattern formed in a carpet including patterns formed when using pile height variations, color, or yarn selection. With yarn tufted into the backing of a patterned carpet in straight rows, the invention may be employed with any type of pattern.

Figure 1:
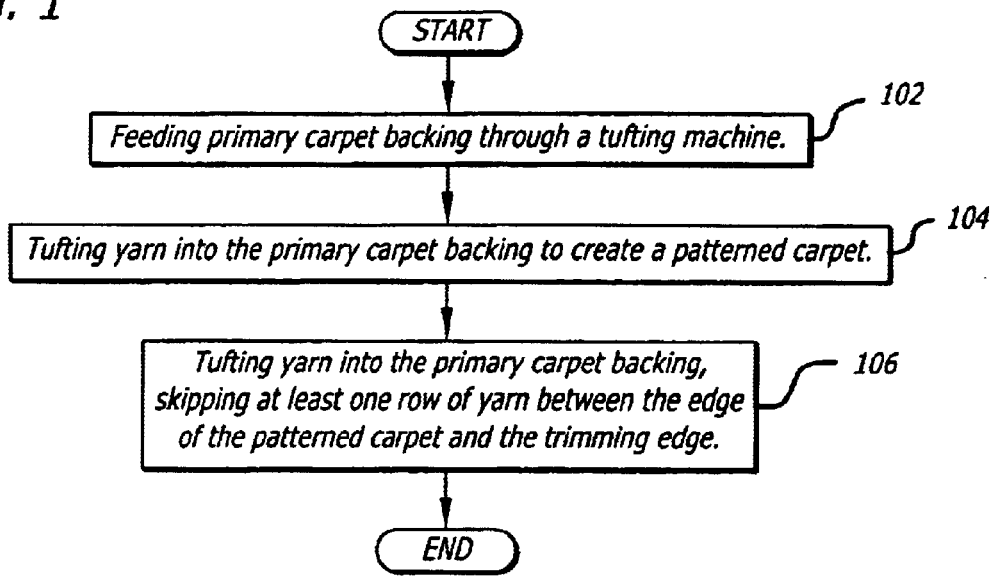
FIG. 1 illustrates a method of manufacturing a carpet with a pre-defined trim line(s) according to one embodiment of the invention.

FIG. 1 illustrates an exemplary method of manufacturing a carpet with one or more pre-defined trim line(s) according to one embodiment of the invention. The carpet backing is fed through the tufting machine (block 102). Yarn may be tufted into the backing by one or more needles to create a patterned carpet (block 104). Yarn is also tufted into the carpet backing along at least one edge of the carpet to create a trimming edge while a trim line is created by skipping at least one row of yarn between the edge of the patterned carpet and the trimming edge 106. In one embodiment, the trimming edge 106 (also referred to herein as the trim edge) may be one-half inch wide or six ends of yarn wide along the edge of the carpet. In various embodiments of the invention, the yarn tufted into the backing along the trimming edge may be different (e.g., of a different color, pile height, texture, etc.) than the yarn tufted into the backing to create the patterned carpet.

Figure 2:
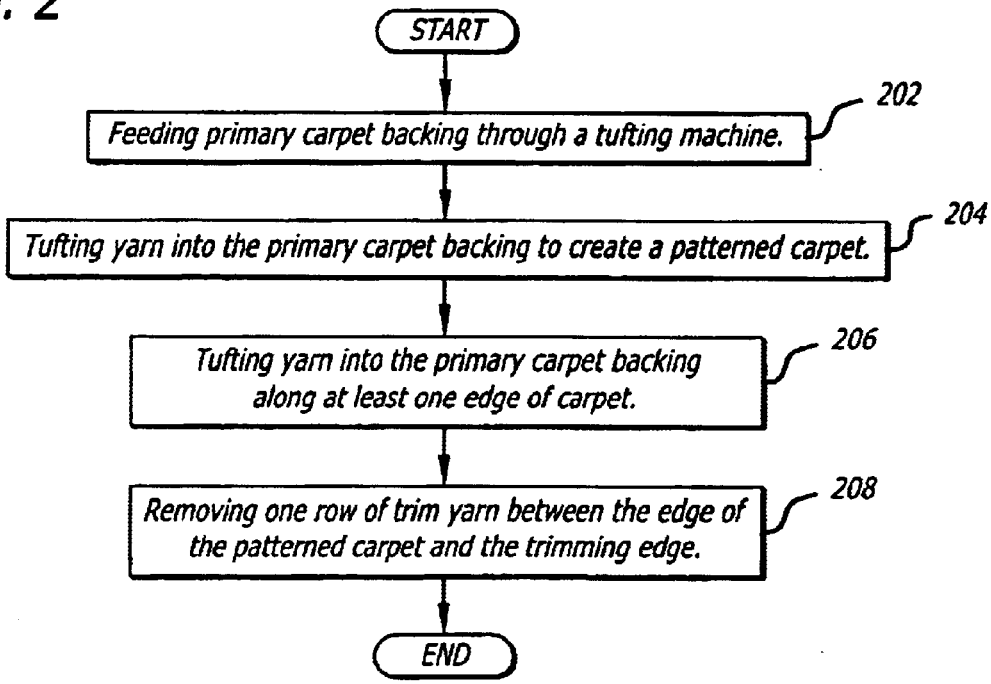
FIG. 2 illustrates another method of manufacturing a carpet with a pre-defined trim line(s) according to one embodiment of the invention.

FIG. 2 illustrates another exemplary method of manufacturing a carpet with one or more pre-defined trim line(s) according to one embodiment of the invention. The carpet backing is fed through the tufting machine (block 202). Yarn may be tufted into the backing by one or more rows of needles to create a patterned carpet (block 204). Trim yarn is also tufted into the carpet backing along at least one edge of the carpet to create a trimming edge (block 206). In one embodiment, a row of yarn along the trimming edge between the edge of the patterned carpet and the trimming edge is then removed to create the trim line (block 208). In another embodiment, a row where yarn would otherwise be tufted is skipped along the trimming edge between the edge of the patterned carpet and the trimming edge to form the trim line.

Figure 3:
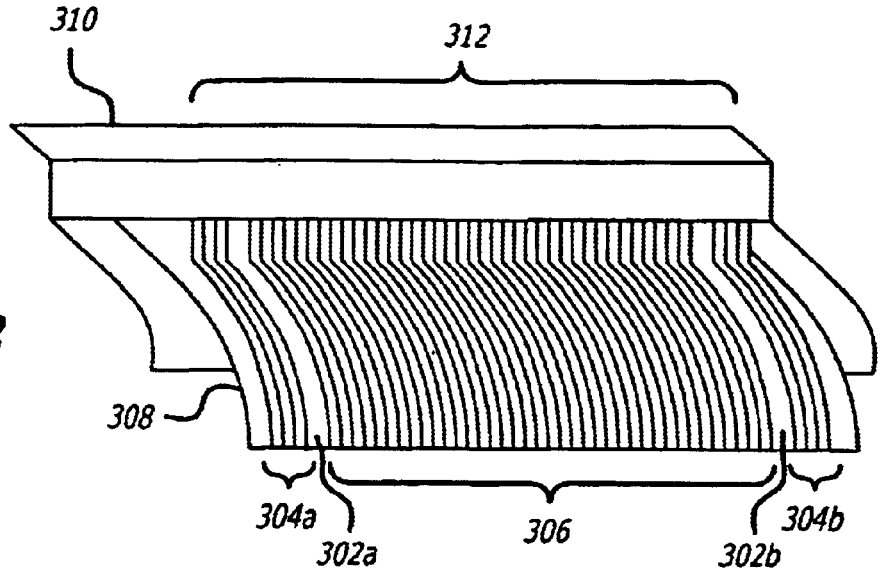
FIG. 3 illustrates how one embodiment of the invention may be implemented during the carpet manufacturing process.

FIG. 3 illustrates how one embodiment of the invention may be implemented during the carpet manufacturing process. The cut line or trim line 302*a* and/or 302*b* may be created by removing an end of yarn from the trim edge 304*a* and/or 304*b*, being the edge adjacent to the carpet pattern 306. This may be accomplished during the manufacturing process as the carpet backing 308 is fed through the tufting machine 310 and yarn is tufted-in by needles 312 running along the width of the carpet. The yarn fed through a particular needle, at the location of the desired cutting line 302*a* and/or 302*b*, may be removed in one implementation of the invention, thus leaving no yarn along of the desired cutting line 302*a* and/or 302*b*. In another implementation of the invention, the needle of the tufting machine 310 may also be removed so that no yarn is tufted-in at the desired cut line 302*a* and/or 302*b* location.

Figure 4:
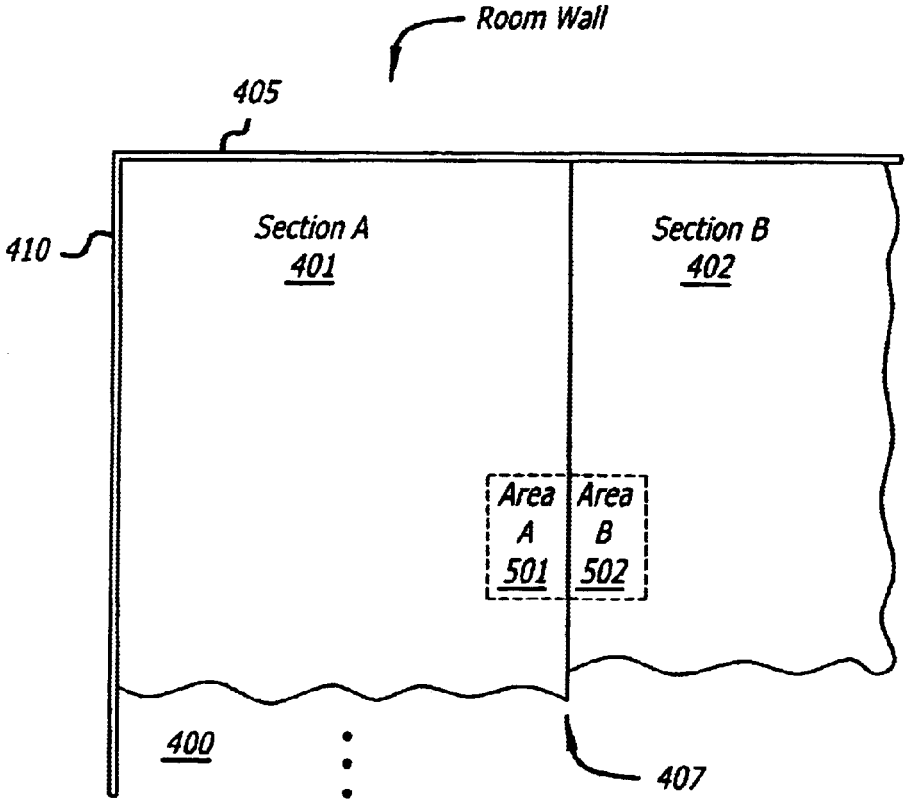
FIG. 4 illustrates how carpet with pre-defined trim lines may be installed and joined along a seam line according to an embodiment of the invention.

FIG. 4 illustrates how carpet with pre-defined trim lines may be installed and joined along a seam line according to an embodiment of the invention. At any given location (e.g., room, conference hall, etc.), a single section of carpet may not be wide enough to cover the desired floor area 400 bounded by walls 405 and 410. Thus, two or more sections of carpet (Section A 401 and Section B 402, cut from the same roll; or not) may be joined together to cover the floor area 400. For example, where a particular carpet is manufactured to be twelve feet wide, three sections of the carpet may be employed to cover a floor area that is thirty-six (36) feet wide by fifty (50) feet long.

FIG. 5 illustrates where two areas of carpet 501 and 502 are to be joined along a seam according to one embodiment of the invention. The top side of each illustrated area of carpet, namely Area A 501 and Area B 502 has a repeating pattern 505 and 506, respectively. These patterns are identified as Pattern A 505 and Pattern B 506. It should be understood that the patterns in FIG. 5 are merely illustrative and many other patterns may be employed without deviating from the invention. For example, other repeating patterns may be formed by a combination of one or more shapes, figures, colors, textures, and/or yarn pile heights, such as another illustrative patterned carpet as shown in FIG. 6.

Referring again to FIG. 5, the carpet areas, Area A 501 and Area B 502, are to be joined along the seam edge 507. Area A 501 and Area B 502 have trim edges 508, which are trimmed or cut in order to join Area A 501 and Area B 502 along the seam edge 507. Trim edges may vary in width and/or the number of yarn piles without departing from the invention. For example, in one embodiment of the invention, each trim edge may be approximately one inch wide. In other embodiments, both trim edges may be wider or narrower than approximately one inch and may differ in size from each other.

Figure 7:
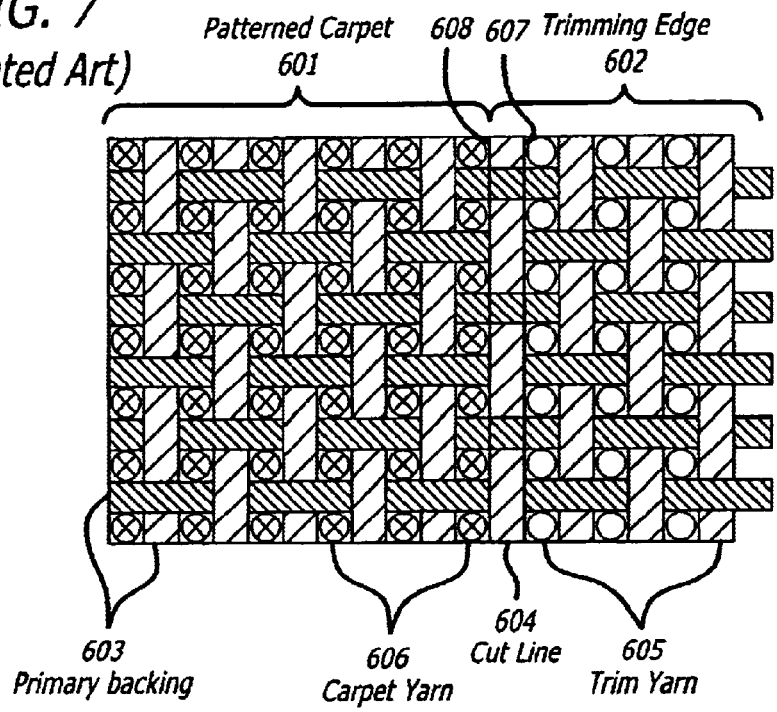
FIG. 7 (Related Art)
FIG. 7 illustrates a patterned carpet with a trim edge.

As previously noted, when currently installing and joining carpet sections, the installers cut the trim edges of a carpet by cutting between the ends of yarn on the top side of the carpet in order to get a good pattern match on the face of the carpet. For example, FIG. 7 illustrates a patterned carpet 601 with a trim edge 602 tufted into a backing 3. An installer would normally have to cut along the cut line 604 between the ends of trim yarn 605 and regular carpet yarn 606, which is part of the pattern. Making a precise cut along the length of the carpet can be difficult because there is very little space between the ends of yarn 605 and 606 as identified by lines 607 and 608 herein. Cutting between the wrong yarns, or cutting across the yarn may leave a noticeable mismatch on the face of the carpet at the seam.

Figure 8:
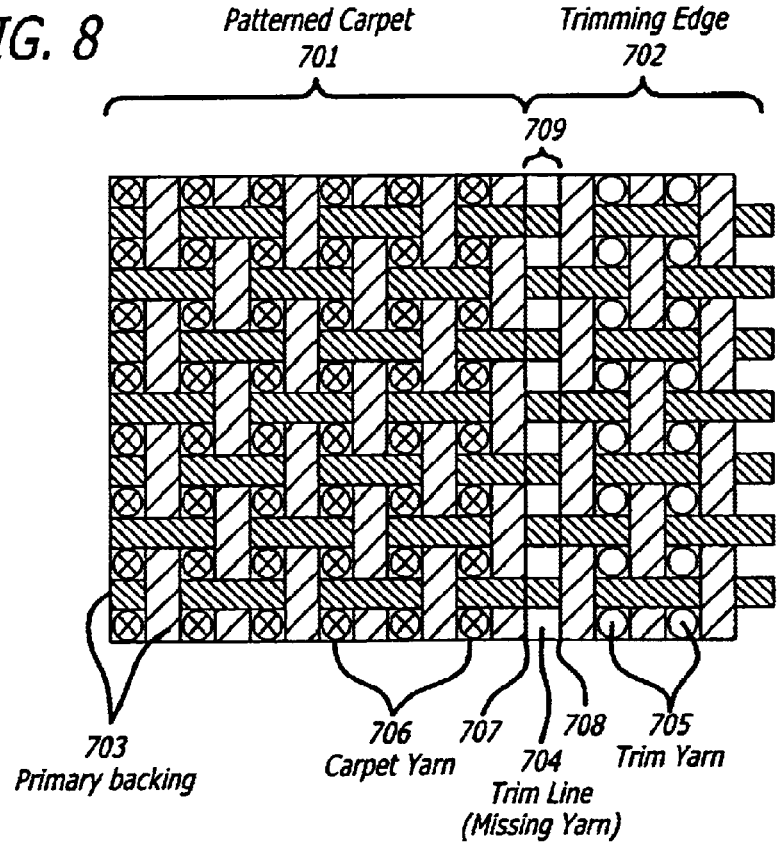
FIG. 8 illustrates one aspect of the invention, where one end of yarn is removed from the tufting machine, just outside the pattern on each edge of the carpet, to identify where an installer may cut and seam the carpet.

FIG. 8 illustrates one aspect of the invention, where one end of yarn is removed from the tufting machine, just outside the pattern 701 on each edge of the carpet, to identify where an installer may cut and seam the carpet. The cut or trim line 704 may be built into the carpet in various ways without departing from the invention. Selecting the exact end of yarn is required, or a pattern mismatch will result.

The "missing end" of yarn (along the trim line 704 between carpet yarn 706 and trim yarn 705) on each edge creates a small gap 709 near each edge of the carpet that makes finding the edge 708 of the pattern easy. The size of the gap is based on the gauge of the tufting equipment and approximately ranges between four-hundredths of an inch (1/25") and one-third of an inch (1/3"). This gap 709 also permits an installer to easily trim along any edge 707 or 708 of the carpet with minimum risk of crossing over other yarns. An installer may easily cut along the gap 709, minimizing the chance of a poor installation resulting from inadequate trimming of the carpet. It is contemplated that more than one end of yarn may be removed so that gap 709 of trim line 704 is equivalent to the width of two or more rows of yarn, each row having a width of approximately one strand of yarn.

FIG. 9 illustrates the view from the edge of the carpet 700 that identifies at least one missing yarn row(s) forming trim line 704. The pattern carpet 701 is trimmed away from trimming edge 702 along trim line 704. In order to provide a more pronounced trim line, more than one yarn row may be arranged to be missing.

FIG. 10 illustrates the exposed bottom view with a secondary backing or cover 800 pulled away from the finished carpet 700. Shown is the match point of one section with the missing yarn trim line 704.

FIG. 11 illustrates how two sections of patterned carpet Section A 902 and Section B 903 may be joined along a junction 906 according to one embodiment of the invention. A section of carpet (e.g., Section A 902) is to be joined with another section of carpet (e.g., Section B 903) along a junction 906 or seam. The trimming edges 904 and 905 are cut along corresponding pre-defined trim lines 907 and 908, which is created according to one embodiment of the invention. The trim lines 907 and 908 are gaps between the patterned carpet 902 and 903 and their respective trimming edges 907 and 908 in which no yarn has been tufted along one or more rows. The absence of yarn along trim lines 907 and 908 helps to mark the seam edges 909 and 910 of the pattern carpet 902 and 903 and enables a direct cut to be made into the backing without contact or impedance by a strand of yarn. This assists an installer to make a straight cut along the trim lines 907 and 908.

Note that in this embodiment, there is a matching of the repeating patterns on Section A 902 to the repeating patterns of Section B 903, which are to be joined along the seam edges 909 and 910. In other embodiments, the same pattern on Section A 902 to Section B 903 may be joined along the seam. However, it should be clear that the invention may be implemented regardless of the type of pattern(s) to be joined along a seam.

FIG. 12 illustrates the view from the edge of the finished carpet of the two sections of patterned carpet in FIG. 11 are to be cut at the trim lines 907 and 908, to cut away the trim edges 904 and 905 so that Section A 902 and Section B 903 can be seamed together at junction 906.

FIG. 13 illustrates the top view of how the two sections of patterned carpet Section A 902 and Section B 903, illustrated in FIG. 11, have been joined along the seam line to form junction 906 according to one embodiment of the invention.

FIG. 14 illustrates the view from the edge of the finished carpet how the two sections of patterned carpet in FIG. 11 have been joined along the seam line 914 (formed by seam edges 909 and 910) or junction 906 according to one embodiment of the invention.

According to one embodiment of the invention, the yarn used for the patterned carpet may be different from the yarn used along the trimming edge.

In one embodiment, the invention may be implemented on a straight stitch broadloom carpet. Since straight stitch carpet is created by tufting yarn in rows along the length of the carpet, a trim line may be created by removing one end of yarn along the trim line.

The embodiments of the invention can decrease the time required to install patterned carpet, improve the quality of carpet seams and the sidematching of sheets of patterned carpets, and increase the probability of successful carpet installations.

While certain exemplary embodiments of the invention have been described and shown in the accompanying drawings, it is to be understood that such embodiments are merely illustrative of and not restrictive on the broad aspects of various embodiments of the invention, and that these embodiments not be limited to the specific constructions and arrangements shown and described, since various other modifications are possible.

What is claimed is:

1. A carpet comprising:

a carpet backing;

carpet yarn tufted into the carpet backing and defining a usable portion of the carpet; and trim yarn tufted into at least one edge of the carpet backing and defining a first trim edge of the carpet, a trim line being defined by a small gap between the usable portion of the carpet and the first trim edge.

2. The carpet of claim 1 wherein the usable portion of the carpet includes a pattern on a top surface opposite the carpet backing.

3. The carpet of claim 2 wherein the pattern on the top surface of the carpet is a repeating pattern along a width of the carpet.

4. The carpet of claim 1 wherein the trim yarn and the carpet yarn have a selected gauge, and the width of the gap between the usable portion of the carpet and the first trim edge depends on the selected gauge.

5. The carpet of claim 1 wherein the width of the gap between the usable portion of the carpet and the first trim edge is the width of at least one row of trim yarn.

6. The carpet of claim 1 wherein the width of the gap is no greater than one-fifth of an inch.

7. The carpet of claim 1 wherein the trim line is formed by removing a row of trim yarn from the first trim edge along a length of the first trim edge.

8. The carpet of claim 1 wherein the trim line lies along at least a portion of the length of the carpet.

9. The carpet of claim 1 wherein the carpet is a straight stitch broadloom carpet.

10. A method of manufacturing carpet comprising:

feeding carpet backing through a tufting machine;

tufting carpet yarn through the carpet backing to form a usable section of the carpet;

tufting trim yarn through the carpet backing to form a trim edge section of the carpet; and forming a pre-defined trim line between the usable section of the carpet and the trim edge section of the carpet, wherein the trim line is defined by forming a small gap between the usable section of the carpet and the trim edge section the carpet.

11. The method of claim 10 wherein the trim line is formed by skipping a row of yarn between the usable section of the carpet and the trim edge section of the carpet.

12. The method of claim 10 wherein the trim line is formed by removing a needle from the tufting machine corresponding to a selected location for the trim line.

13. The method of claim 10 wherein the trim line is formed by removing the yarn from a needle in the tufting machine corresponding to a selected location for the trim line.

14. The method of claim 10 wherein the width of the gap between the usable section of the carpet and the first trim edge is at least the width of one row of yarn.

15. The method of claim 10 wherein the trim line is formed by removing at least one row of yarn from the trim edge along the length of the trim edge.

16. The method of claim 10 wherein the carpet is a straight stitch broadloom carpet.

17. The method of claim 10 further comprising:

forming a pattern on the usable section of the carpet on a top surface of the carpet.

18. The method of claim 17 wherein the pattern on the first surface of the carpet is a repeating pattern along the width of the carpet.

19. The method of claim 10 wherein the trim yarn and the carpet yarn have a common gauge, and the width of the gap between the usable section of the carpet and the trim edge section of the carpet depends on the common gauge.

20. The method of claim 10 wherein the width of the gap between the usable section of the carpet and the trim edge section is a width of at least one row of yarn.

21. The method of claim 10 wherein the forming of the trim line is accomplished by removing a row of yarn along at least a portion of the length of the trim edge section.

22. A method of joining two sections of carpet comprising:

identifying a pre-defined trim line along a first edge of a first section of carpet, the pre-defined trim line being an absence of yarn;

cutting the first section of carpet along the pre-defined trim line; and joining the first edge of the first section of carpet to a second section of carpet.

23. The method of claim 22 wherein the trim line is formed by avoidance of tufting a row.

24. The method of claim 22 wherein the trim line is formed by removal of a row of yarn.

25. The method of claim 22 wherein the first section of carpet includes (i) carpet yarn tufted in a backing associated with a usable portion of the first section of carpet, and (ii) trim yarn tufted in the backing along a trim edge of the first section of carpet.

26. The method of claim 25 wherein the pre-defined trim line in the first section of carpet lies between the usable portion of the first section of carpet and the trim edge.

27. The method of claim 25 wherein the pre-defined trim line is formed by removing a row of trim yarn of the trim edge that is adjacent to the usable portion of the first section of carpet.

28. The method of claim 22 wherein the trim line lies along the entire length of the first section of carpet.

29. The method of claim 22 further comprising:

identifying a pre-defined trim line along a first edge of the second section of carpet;

cutting the second section of carpet along the pre-defined trim line of the second section of carpet; and joining the first edge of the first section of carpet to the first edge of the second section of carpet.

30. The method of claim 22, wherein the cutting of the first section of carpet along the pre-defined trim line includes directly cutting a backing of the carpet between a gap forming the pre-defined trim line, the gap having a width of at least one row of yarn.

31. A carpet comprising:

a carpet backing;

yarn coupled to the carpet backing to form a usable portion of the carpet; and yarn coupled to the carpet backing along an edge of the carpet backing to form a trim edge and spaced away from the usable portion of the carpet by a trim line defined by an absence of yarn.

32. The carpet of claim 31 wherein the trim line is a gap between the yarn forming the usable portion of the carpet and the yarn forming the trim edge.

33. The carpet of claim 32 wherein the yarn forming the usable portion of the carpet having a gauge, and a width of the gap forming the trim line is based on the gauge of the yarn forming the usable portion of the carpet.

34. The carpet of claim 32 wherein a width of the gap between the yarn forming the usable portion of the carpet and the yarn forming the trim edge is a width of at least one row of yarn.

35. The carpet of claim 32 wherein a width of the gap between the yarn forming the usable portion of the carpet and the yarn forming the trim edge is a range from five-hundredths of an inch through one-tenth of an inch, inclusive.

36. The carpet of claim 31 wherein the trim line to be formed by removing a row of yarn coupled between the usable portion of the carpet and the trim edge.

37. The carpet of claim 31 wherein the trim line to be formed by skipping a row where yarn would otherwise be coupled between the trim edge and the usable portion of the carpet.

38. The carpet of claim 31 wherein the yarn is coupled to the carpet backing by tufting.

39. The carpet of claim 31 wherein the trim line is a gap between patterns of yarn in the carpet to improve sidematching of sheets of carpet.

* * * * *